US009951554B1

(12) United States Patent
Beckner

(10) Patent No.: US 9,951,554 B1
(45) Date of Patent: Apr. 24, 2018

(54) STORAGE DOOR WEATHER STRIP

(71) Applicant: Ina Beckner, Tucson, AZ (US)

(72) Inventor: Ina Beckner, Tucson, AZ (US)

( * ) Notice: Subject to any disclaimer, the term of this patent is extended or adjusted under 35 U.S.C. 154(b) by 0 days.

(21) Appl. No.: 15/732,199

(22) Filed: Oct. 3, 2017

(51) Int. Cl.
*E06B 7/23* (2006.01)

(52) U.S. Cl.
CPC ..... *E06B 7/2316* (2013.01); *E06B 7/231* (2013.01); *E06B 7/2307* (2013.01)

(58) Field of Classification Search
CPC .... E06B 7/2307; E06B 7/2309; E06B 7/2316; E06B 7/231; E06B 7/6015; E06B 7/2312; E06B 7/2314
See application file for complete search history.

(56) References Cited

U.S. PATENT DOCUMENTS 2,136,687 A * 11/1938 Matheny ..... E06B 7/231 49/493.1
2,319,709 A * 5/1943 Spraragen ..... E06B 7/2314 36/57
2,724,876 A * 11/1955 Chagnon ..... E06B 7/2301 220/DIG. 3
2,933,782 A * 4/1960 Cornell ..... E06B 7/2316 49/469
3,390,486 A * 7/1968 Walters ..... A47K 3/36 16/237
3,535,824 A * 10/1970 Kessler ..... B29C 47/067 156/244.24
3,987,587 A * 10/1976 Miller ..... E06B 7/2316 49/482.1
4,300,314 A * 11/1981 Dittrich ..... E06B 1/70 49/470
4,447,989 A * 5/1984 Mailand ..... E06B 7/2316 49/482.1
4,497,136 A * 2/1985 Khallil ..... E06B 7/16 49/480.1
5,009,036 A * 4/1991 Ryan ..... E06B 7/231 49/475.1
5,435,104 A * 7/1995 Dietrich ..... B60J 5/14 49/475.1
5,465,532 A * 11/1995 Varin ..... E06B 7/2316 49/470
5,572,840 A * 11/1996 Fast ..... E06B 1/6015 49/504
5,784,834 A * 7/1998 Stutzman ..... E06B 7/2307 49/197
6,772,560 B2 * 8/2004 Dischiant ..... E06B 7/23 49/197

(Continued)

*Primary Examiner* — Justin B Rephann

(57) ABSTRACT

A storage door weather strip assembly having a rubber strip, a plurality of tube holding brackets and a rigid tube. The tube has a horizontally disposed slit traveling its length. The brackets each have a C shaped member attached to a flat plate. The rubber strip includes a round cross section capable of sliding into the tube. The rubber strip also including a horizontally disposed rubber panel which terminates in an L shaped strip. The round cross section rubber portion slides into the tube. The horizontally disposed rubber panel protrudes from the slit in the tube. The tube holding brackets are mounted onto the front portion of the storage door along its bottom edge. The tube snaps into the brackets so that the lowest portion of the L shaped rubber strip touches the ground creating a weather tight seal.

2 Claims, 3 Drawing Sheets

(56) References Cited

U.S. PATENT DOCUMENTS

| | | | | |
|---|---|---|---|---|
| 6,772,561 | B1 * | 8/2004 | Berger, Jr. | E06B 1/522 160/40 |
| 7,971,400 | B2 * | 7/2011 | Boldt | E06B 1/30 52/204.1 |
| 8,161,685 | B2 * | 4/2012 | Salgado | E06B 7/2303 160/40 |
| 8,627,610 | B1 * | 1/2014 | Crowther | E04H 1/1266 16/250 |
| 8,881,464 | B1 * | 11/2014 | Huckeba | E06B 7/231 49/197 |
| 9,845,638 | B1 * | 12/2017 | Cunningham | E06B 7/22 |
| 2011/0113696 | A1 * | 5/2011 | Gallagher | E06B 7/205 49/493.1 |
| 2012/0131854 | A1 * | 5/2012 | Pettingill | E06B 7/2316 49/478.1 |
| 2012/0260579 | A1 * | 10/2012 | DeMello | E06B 7/2309 49/477.1 |
| 2014/0259954 | A1 * | 9/2014 | Peck | E06B 7/16 49/489.1 |
| 2017/0218689 | A1 * | 8/2017 | Boer | E06B 5/003 |

* cited by examiner

STORAGE DOOR WEATHER STRIP

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of weather strip assemblies and more specifically to storage door weather strip assembly.

Many people have a need to store excess items in a storage facility. A storage facility generally includes an number of individual spaces, each accessed by a roll up type storage door. The doors sometimes have a rubber sealing strip attached to the bottom edge of the door to keep out moisture and other weather related elements.

Although the existing rubber strips are effective, they do eventually deteriorate and need replacement.

A deficiency in the current design is that the owner of the storage facility cannot replace the weather strip without calling the renter of the storage space to come in and open the door, thereby allowing access to the strip. This is time consuming and an inconvenience for both the storage facility owner and the renter of the storage space.

BRIEF SUMMARY OF THE INVENTION

The primary object of the invention is to provide an attachable weather strip assembly for the bottom of a storage door that can be attached without needing to physically open the storage door thereby eliminating the need for the renter of the storage space to be present when the weather strip is being replaced.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed a storage door weather strip assembly comprising: a rubber strip, a plurality of tube holding brackets, a tube member, said tube member having a horizontally disposed slit traveling the length of said tube member, said brackets each having a C shaped member fixedly attached to a flat rectilinear plate so that said C shape extends in a forward in a vertical orientation from said rectilinear plate, said rubber strip having a round cross section capable of slidably engaging said tube member, said rubber strip including an integral horizontally disposed rubber panel, said horizontally disposed rubber panel terminating in an integral L shaped strip, said horizontally disposed rubber panel capable of penetrating and exiting said slit in said tube member, said L shaped rubber strip capable of engaging with the ground in front of a storage door, said tube holding brackets capable of being mounted onto the front portion of said storage door along its bottom most portion, and said tube capable of snapping into said tube holding brackets so that the lowest L shaped portion of said rubber strip is in close proximity with the ground creating a weather tight seal.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
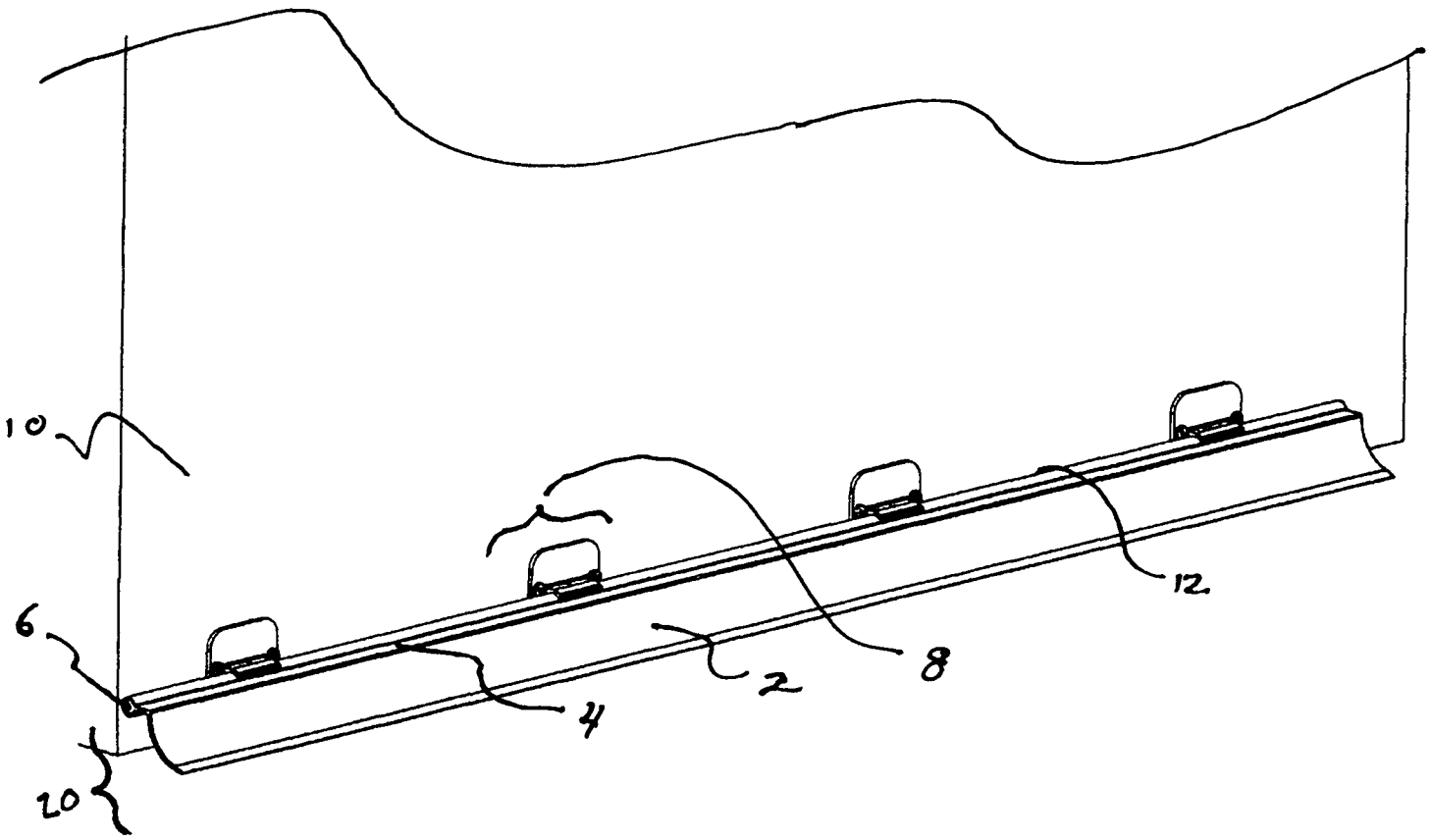
FIG. 1 is a perspective view of the invention.

Referring now to FIG. 1 we see a perspective view of the invention 100. Rectilinear plates 8 are fastened to the bottom area of a standard roll up storage door 10. The brackets hold a rigid tube 12 which has a horizontally disposed slit 13 running the length of the tube 12. A rubber rod 6 is inserted into the tube 12 and also runs the length of the tube 12. A horizontally positioned rubber panel 4 is attached to rubber rod 6 on one side and protrudes through slit 13 on the other side. An approximately L shaped rubber strip 2 is attached to horizontal strip 4 on one side and extends down and terminates at the ground plane. This strip 2 effectively prevents water and other debris from entering the underside of the door 10. Because the weather strip assembly 100 can be mounted to the outside of the door 10, there is no need to involve the renter of the storage space when needing to remove or replace the weather strip assembly 100.

Figure 2:
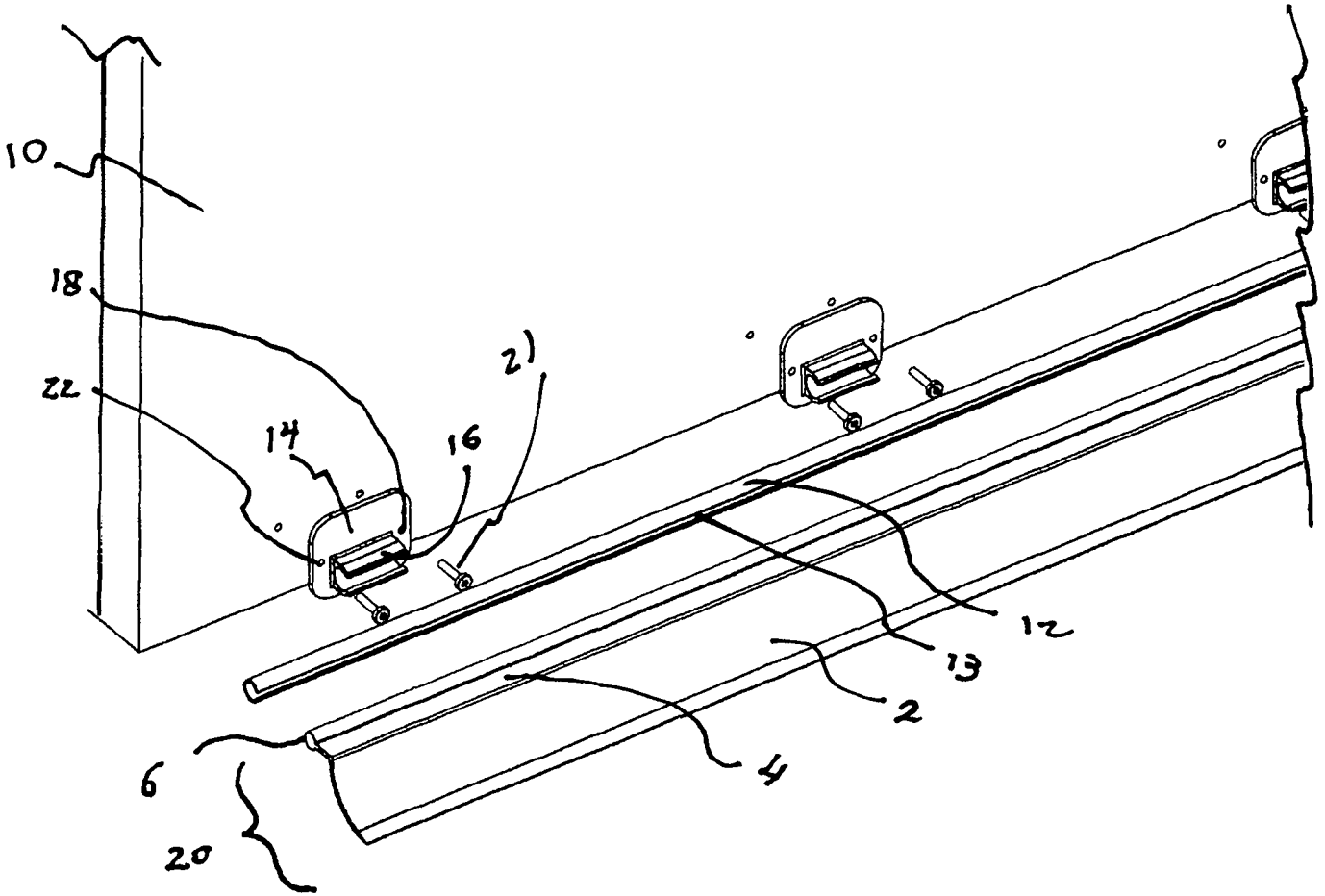
FIG. 2 is an exploded view of the invention.

FIG. 2 is an exploded view of the invention. Retaining clip 8 is comprised of a rectilinear panel 14 and attached C shaped clip 16. Apertures 18, 22 can accept a standard self-tapping screw to attach the clip 8 to the outside of a standard roll up storage door. Rubber member 20 can be seen prior to insertion into tube member 12.

Figure 3:
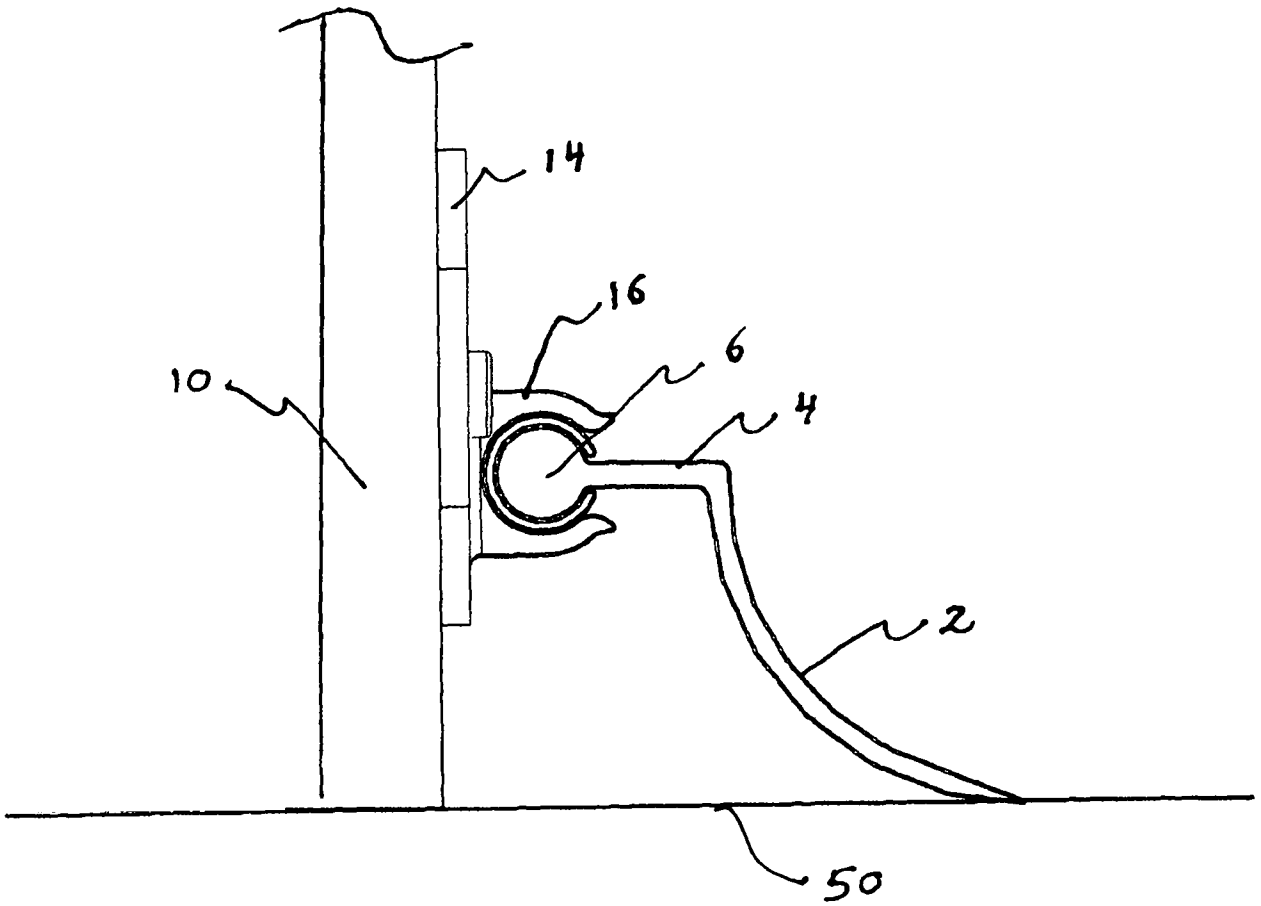
FIG. 3 is a side view of the invention.

FIG. 3 is a side view of the invention 100. Rectilinear plate 14 is attached to door 10 via screws 22, 24. L shaped rubber strip 2 terminates at the ground plane 50.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A storage door weather strip assembly comprising:

a rubber strip;

a plurality of tube holding brackets;

a tube member;

said tube member having a horizontally disposed slit traveling the length of said tube member;

said brackets each having a C shaped member fixedly attached to a flat rectilinear plate so that said C shape extends in a forward and vertical orientation from said rectilinear plate;

said rubber strip having a round cross section capable of slidably engaging said tube member;

said rubber strip including an integral horizontally disposed rubber panel;

said horizontally disposed rubber panel terminating in an approximately L shaped strip;

said round cross section rubber strip capable of sliding into said tube member;

said horizontally disposed rubber panel capable of penetrating and protruding from said slit in said tube member;

said approximately L shaped rubber strip capable of engaging with the ground in front of a storage door;

said tube holding brackets capable of being mounted onto a front portion of said storage door along a bottom most portion; and said tube capable of snapping into said tube holding brackets so that the lowest portion of said approximately L shaped portion of said rubber strip is in close proximity with the ground creating a weather tight seal.

2. A storage door weather strip as claimed in claim 1 wherein said weather strip assembly can be attached to, or removed from the storage door without the need for the storage door to be opened.

* * * * *